US007462385B2

(12) United States Patent
Seth et al.

(10) Patent No.: US 7,462,385 B2
(45) Date of Patent: Dec. 9, 2008

(54) DISPOSABLE CLEANING IMPLEMENT

(75) Inventors: Jayshree Seth, Woodbury, MN (US); Ronald W. Ausen, St. Paul, MN (US); Kim C. Sachs, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 700 days.

(21) Appl. No.: 10/686,123

(22) Filed: Oct. 14, 2003

(65) Prior Publication Data

US 2005/0079315 A1 Apr. 14, 2005

(51) Int. Cl.
*A47L 13/16* (2006.01)
*B32B 3/02* (2006.01)

(52) U.S. Cl. ..... 428/86; 428/92; 428/99; 428/107; 428/172; 428/173; 442/237; 442/238; 442/394; 442/366; 15/237; 15/238

(58) Field of Classification Search ..... 428/99, 428/100, 86, 92, 107, 172, 173; 442/1–58, 442/237, 238, 394, 366; 15/237, 238, 229, 15/12
See application file for complete search history.

(56) References Cited

U.S. PATENT DOCUMENTS

| | | | | |
|---|---|---|---|---|
| 3,266,133 | A | | 8/1966 | Flanagan, Jr. |
| 3,485,706 | A | | 12/1969 | Evans |
| 3,557,413 | A | | 1/1971 | Engle |
| 3,638,270 | A | * | 2/1972 | Schlegel et al. ..... 15/114 |
| 4,001,366 | A | | 1/1977 | Brumlik |
| 4,042,995 | A | | 8/1977 | Varon |
| 4,056,593 | A | | 11/1977 | de Navas Albareda |
| 4,189,809 | A | | 2/1980 | Sotos |
| 4,537,819 | A | * | 8/1985 | Schortmann et al. ..... 442/370 |
| 4,612,226 | A | | 9/1986 | Kennette et al. |
| 4,703,538 | A | | 11/1987 | Silverstrone |
| 4,894,060 | A | | 1/1990 | Nestegard |
| 4,980,943 | A | | 1/1991 | Barber |
| 5,036,561 | A | | 8/1991 | Calafut |
| 5,100,400 | A | | 3/1992 | Mody et al. |
| 5,419,015 | A | | 5/1995 | Garcia |
| 5,525,397 | A | | 6/1996 | Shizuno et al. |
| 5,560,794 | A | * | 10/1996 | Currie et al. ..... 156/73.2 |
| 5,569,521 | A | | 10/1996 | Francoeur, Sr. et al. |
| 5,771,522 | A | | 6/1998 | Carmody |
| 5,878,034 | A | | 3/1999 | Hershey et al. |
| 5,956,770 | A | | 9/1999 | Dennis |
| 6,014,788 | A | | 1/2000 | Jaffri |

(Continued)

FOREIGN PATENT DOCUMENTS

| | | |
|---|---|---|
| CA | 2 047 010 | 1/1992 |

(Continued)

*Primary Examiner*—Elizabeth M Cole

(57) ABSTRACT

The present invention relates to an improved disposable cleaning sheet for removing debris, especially hair from a non-smooth or rough surface, especially fibrous type surfaces such as carpeting or upholstery. The cleaning sheets comprise a fibrous substrate and a plurality of protrusions extending from strand elements embedded within fibrous substrate. The cleaning sheets use the protrusions to dislodge the debris from the surface being cleaned, and the fibrous substrate captures the dislodged debris without a backing for the protrusions interfering with the particle capture of the fibrous substrate. Further, the protrusions are firmly embedded within the fibrous substrate such that they cannot be dislodged from the substrate in use.

40 Claims, 6 Drawing Sheets

U.S. PATENT DOCUMENTS

| | | | |
|---|---|---|---|
| 6,209,177 | B1 | 4/2001 | Murasaki |
| 6,260,228 | B1 | 7/2001 | Arroyo-Youngblood |
| 6,513,184 | B1 | 2/2003 | Brown et al. |
| 2001/0016245 | A1 | 8/2001 | Tuman et al. |
| 2002/0023666 | A1 | 2/2002 | Tawara et al. |
| 2002/0049407 | A1 | 4/2002 | Hill et al. |
| 2002/0166573 | A1 | 11/2002 | Policicchio et al. |
| 2003/0009144 | A1 | 1/2003 | Tanzer et al. |
| 2003/0044569 | A1 | 3/2003 | Kacher et al. |
| 2003/0049407 | A1 | 3/2003 | Kacher et al. |
| 2004/0261232 | A1 | 12/2004 | Kurtz, Jr. et al. |

FOREIGN PATENT DOCUMENTS

| | | | |
|---|---|---|---|
| EP | 0 468 301 | A1 | 7/1991 |
| EP | 0 586 036 | A1 | 3/1993 |
| EP | 0 903 105 | A1 | 9/1998 |
| JP | 9224901 | | 9/1997 |
| JP | 2001190487 | | 7/2001 |
| JP | 2003/199624 | A | 7/2003 |
| WO | WO 96/03101 | | 2/1996 |
| WO | WO 02/096233 | A1 | 12/2002 |

* cited by examiner

DISPOSABLE CLEANING IMPLEMENT

BACKGROUND OF THE INVENTION

The present invention relates to cleaning sheets comprising protrusions embedded within a cleaning sheet for cleaning soft or fibrous type substrates, such as difficult to remove debris including pet hair or dirt from carpeting, upholstery, or clothing.

U.S. Patent Publication No. 2003/0044569 describes a cleaning sheet that has been provided with protrusions that are affixed to a cleaning sheet substrate. The protrusions provide enhanced cleaning functionality by dislodging dirt and other debris from surfaces, particularly rough or fibrous type surfaces that have crevices where dirt can become lodged and be difficult to remove with a standard dry cleaning cloth or the like. The problem with this wipe however is that the protrusions are attached to the surface of the cleaning implement or cloth usually with a film type backing. This substantially reduces the surface area of the cleaning sheeting available for cleaning. Further, the protrusions can easily become dislodged and fall off.

U.S. Pat. No. 4,703,538 issued to Silverstrone discloses a cleaning tool suited for picking up dirt, lint, and the like from rugs, floors, upholstered furniture and other surfaces. The cleaning tool of Silverstrone has a roller with an external surface made of hook material. The roller is pushed over the surface to be cleaned to pick up dirt, lint, and the like, and then must be manually cleaned when dirt accumulates in the hook material.

A tool for removing animal hair from carpeting is also disclosed in U.S. Pat. No. 4,042,995 issued to Varon. The tool has polyethylene bristles on a head attached to a handle. The density of the bristles at the trailing edge is greater than elsewhere and the bristles are arranged in a saw-tooth leading edge pattern. As the tool is pulled through carpeting, the bristles pick up animal hair. The bristles are permanently attached to the head of the broom handle and again need to be manually cleaned.

A device for removing fiber pills and lint from fabrics is disclosed in U.S. Pat. No. 5,036,561 issued to Calafut. This device has a supporting substrate, such as a foam sheet, that has on one surface an abrasive coating of substantially uniform particles having 280-600 grit size for removing pills from fabrics and has on its other surface a fabric with slanted pile or the like to remove lint from fabrics. The device is sized to fit in a person's pocket or purse. The abrasive side of the device is rubbed against the fabric to remove or dislodge the pills. The lint removing pile fabric side of the brush is designed to remove lint when drawn in one direction and then releases the lint when drawn in the opposite direction.

Adhesive rollers for removing lint and debris are described in U.S. Pat. No. 6,014,788; U.S. Pat. No. 5,878,034 and U.S. Publication No. US2002/0023666A1, and are known for use with carpets, upholstery and other types of fabric. The adhesive surface of these rollers is quickly covered with dust and must be replaced.

SUMMARY OF THE INVENTION

The present invention relates to an disposable cleaning sheet for removing debris, especially hair and dirt, from a non-smooth or rough surface, especially fibrous type surfaces such as carpeting or upholstery. The cleaning sheets comprise a fibrous substrate and a plurality of protrusions extending from strand elements embedded within the fibrous substrate.

The present invention cleaning sheets use the protrusions to dislodge the debris from the surface being cleaned, and the fibrous substrate captures the dislodged debris without a backing for the protrusions interfering with the particle capture of the fibrous substrate. Further, the protrusions are firmly embedded within the fibrous substrate such that they cannot be dislodged from the substrate in use.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE INVENTION

The disposable cleaning sheets of the present invention generally comprise a fibrous substrate and a plurality of protrusions, such as hooks, embedded within the fibrous substrate. The cleaning sheet could be used as a discrete sheet or with a backing, for example it could be removably attached to a cleaning implement and subsequently disposed of.

Figure 5:
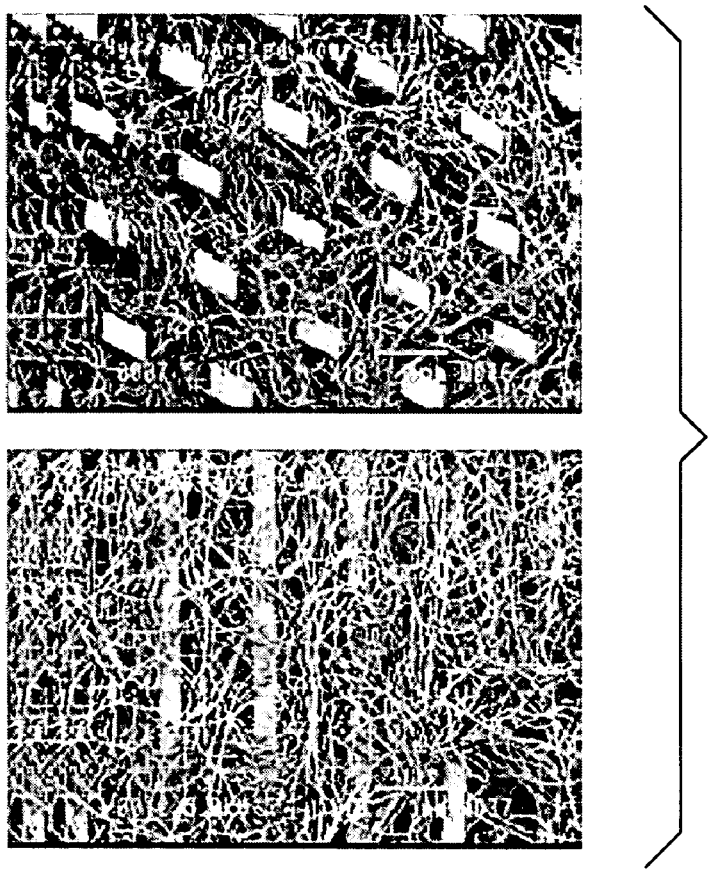
FIG. 5 are photomicrograph top and bottom views of a first embodiment protrusion containing netting such as in FIG. 4(*a*) embedded into a fibrous web in accordance with the present invention to form a cleaning sheet.
Figure 6:
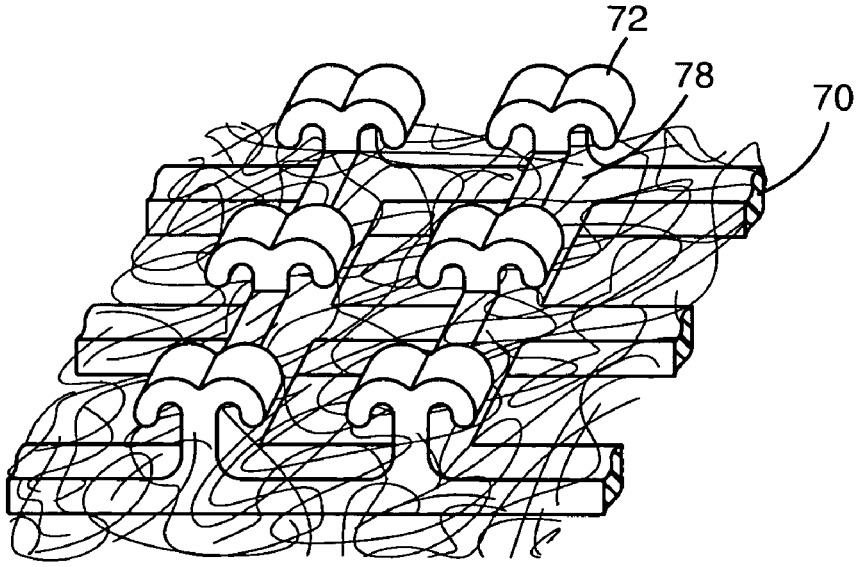
FIG. 6 is a schematic drawing of an embodiment of a protrusion hook netting embedded into a fibrous web in accordance with the present invention to form a cleaning sheet.

Embodiments of disposable cleaning sheets of the present invention are shown in FIGS. 5 and 6.

The protrusions used in the invention cleaning sheet are formed with protrusions provided on one or more backing elements that can be in the form of a netting or strand elements. These protrusion containing backing elements, for example in the form of discrete or connected strands or one or more nettings are then embedded within a fibrous web, forming a cleaning sheet. The protrusions are preferably on strand elements that are connected so as to form a netting and oriented at angles to each other in the net form. The strands, whether isolated or partially connected strand elements or more firmly connected into a net form, generally have a first outer face and a second outer face and two side faces. The strands, on at least one of the first or second outer faces, have a plurality of protrusions. The protrusion containing strands are embedded within a fibrous web, e.g., a nonwoven web, preferably by hydroentangling the fibers of the nonwoven web around the strands, preferably without the use of auxiliary attachment means such as adhesives or point bonding (e.g., heat bonding, ultrasonic bonding or the like).

The nonwovens useful in the present cleaning sheets include a wide variety of different types of nonwovens made of synthetic, natural, or hybrid fibers. The nonwoven substrates can be made from a variety of processes including, but not limited to, hydroentangling, spunbonding, needlepunching, carding, and the like. Preferred nonwoven substrates are selected from the group consisting of spunbonded substrates, meltblown substrates, hydroentangled substrates, needlepunched substrate, airlaid substrates, carded substrates, and combinations thereof. The fibrous substrates can also be laminates of two or more layers one of which is a suitable nonwoven substrate.

Fibrous materials suitable for forming the preferred nonwoven substrates of the present cleaning sheets include, for example, natural cellulosics as well as synthetics such as polyolefins (e.g., polyethylene and polypropylene), polyesters, polyamides, synthetic cellulosics (e.g., RAYON®), and blends thereof. Also useful are natural fibers, such as cotton or blends thereof and those derived from various cellulosic sources. Preferred starting materials for making the substrates of the present cleaning sheets are synthetic materials, which may be in the form of carded, spunbonded, meltblown, airlaid, or other structures. Particularly preferred are polyesters, especially carded polyester fibers, polypropylene fibers, and polyethylene fibers. The resistance to abrasion and tearing of the substrate as the cleaning sheet is rubbed across the surface, e.g. carpet, upholstery, or other fabric surface, can be an important factor in selecting the form of the substrate and the fiber composition. The degree of hydrophobicity or hydrophilicity of the fibers is further optimized depending upon the desired goal of the sheet, either in terms of type of soil to be removed, the type of additive that is provided, when an additive is present, biodegradability, availability, and combinations of such considerations. In general, the more biodegradable materials are hydrophilic, but the more effective materials tend to be hydrophobic.

The fibrous substrates can be formed from a single fibrous layer or can be a laminate of two or more separate layers. Preferably, the sheets are nonwovens made via a hydroentangling or needlepunching process. In this regard, prior to hydroentangling discrete layers of fibers, it may be desired to slightly entangle each of the layers prior to joining the layers by entanglement.

The nonwoven substrate is preferably initially made to have sufficient free fibers to be entangled around the protrusion containing backing elements. The nonwoven could also, or in addition, be treated prior to the entangling to unbond fibers. For example, the nonwoven can be, e.g., mechanically stretched and worked (manipulated), e.g., by using grooved nips or protuberances, prior to entangling to unbond the fibers so as to provide the mobility to the fibers needed to entangle the hook containing strands. Generally, nonlimiting examples of suitable nonwoven webs include dry laid webs, carded webs, spunbond webs, meltblown webs and combinations thereof. The webs can be elastic or inelastic. The nonwoven web would have a basis weight of from 10 to 500 g/m$^2$, preferably 20 to 200 g/m$^2$, or most preferably 30 to 100 g/m$^2$.

The fibers of the nonwoven webs need not be unbonded when passed into the entangling step. However, it is necessary that during entangling there are sufficient free fibers or fiber portions (that is, the fibers or portions thereof are sufficiently mobile) to provide the desired degree of entanglement and embedding of the protrusion containing backing element or elements within the nonwoven web. Such fiber mobility can possibly be provided by the force of the jets during hydraulic entangling or needles with needlepunch type entangling or by the structure of the nonwoven web or by mechanically or otherwise disrupting the web to create free or mobile fibers.

A hydraulic entangling technique generally involves treatment of a laminate of at least the nonwoven substrate and the protrusion containing backing element or elements, while supported on an apertured support, with streams of liquid from jet devices. The support can be a mesh screen or forming wires or an apertured plate. The support can also have a pattern so as to form a nonwoven material with such pattern, or can be provided such that the hydraulically entangled nonwoven protrusion containing substrate is non-patterned. The apparatus for hydraulic entanglement can be any conventional apparatus, such as described in U.S. Pat. No. 3,485,706, the contents of which are incorporated herein by reference in its entirety. In such an apparatus, fiber entanglement is accomplished by jetting liquid (e.g., water) supplied at pressures, for example, of at least about 200 psi (gauge), to form fine, essentially columnar, liquid streams toward the surface of the supported laminate. The supported laminate is traversed with the streams until the fibers of the nonwoven web are randomly entangled and intertwined with the hook containing backing elements. The laminate can be passed through the hydraulic entangling apparatus a number of times on one or both sides, with the liquid being supplied at pressures of from about 50 to 3000 psi (gauge). The orifices which produce the columnar liquid streams can have typical diameters known in the art, e.g., 125 microns (0.005 inch), and can be arranged in one or more rows with any number of orifices in each row. Various techniques for hydraulic entangling are described in the aforementioned U.S. Pat. No. 3,485,706, and this patent can be referred to in connection with such techniques. Other entangling techniques include mechanically entangling by needle punching. Optionally, other functional layers could be incorporated into the laminate during the entangling operation. The other layers would be foraminous or otherwise entangleable and could include knitted webs, woven webs, other functional nettings or strands or fibrous nonwoven webs. This optional entangleable layer could be used to add strength, elasticity, aesthetics, graphics, softness, rigidity or other desired properties.

After the laminate has been entangled to form a composite web or precursor cleaning sheet, it may, optionally, but not preferably, be treated at a bonding station (not shown in FIG. 1) to further enhance its strength. Such a bonding station is disclosed in U.S. Pat. No. 4,612,226., the contents of which are incorporated herein by reference. Other optional secondary bonding treatments include thermal bonding, ultrasonic bonding, adhesive bonding, combinations of bonding treatments, etc. Such secondary bonding treatments provide added strength, may also stiffen the resulting product (that is, provide a product having decreased softness) and decrease its loft, as such may not be preferred. In the preferred embodiments, all or substantially all secondary bonding is omitted or used at a level of less than 30 percent or preferably less than 15 percent and most preferably less than 5 percent of the surface area of the composite.

After the composite has been entangled, it can be dried by drying cans (or other drying means, such as an air through dryer, known in the art), and wound on a winder.

The formed invention composite comprises protrusion containing backing elements enmeshed or embedded within a fibrous substrate such that fibers of the fibrous substrate are present on both outer faces of the protrusion backing element(s) and preferably fibers on both outer faces of the hook element containing backing element(s) are entangled with each other. For example, a single given fiber could be found on both faces of a given strand and could also be entangled with other fibers on one or both faces of a given strand. The fibers with the embedded protrusion containing backing element are preferably not stratified as distinct layers, but a single integral web structure composite. This provides an integral protrusion composite without the need for secondary bonding treatments such as adhesive or thermal bonding of the backing elements or strands to the fibers.

The protrusion containing backing elements and the fibrous substrate are preferably coextensive along a longitudinal direction of the composite cleaning sheet or wipe and preferably are in some embodiments coextensive across the entire composite structure. This provides a wipe composite that is dimensionally stable preferably at least in the longitudinal or transverse direction. When the protrusion backing elements comprise strands in a coherent net form the composite generally has dimensional stability (as above) in at least two directions. The fibrous substrate coupled with the protrusion containing backing elements or strands in an integral composite creates a cleaning sheet where the protrusions and the entangled fibrous substrate are coextensive.

The formed cleaning sheet is preferably extremely flexible where the flexibility of the composite is substantially that of the protrusion element containing backing element, for example, having a Gurley Stiffness less than 400 Gurley Stiffness units, preferably less than 200 Gurley Stiffness units. As adhesive or thermal lamination is not necessary, the protrusions are not destroyed in the lamination process so that protrusions can be substantially uniformly and continuously distributed in a given longitudinal or transverse extent along a backing element either continuously or intermittently, which extents can be linear or nonlinear. The protrusions are preferably uniformly distributed in all extends of the composite cleaning sheet in a given direction containing the protrusion containing backing, and most preferably in both the longitudinal and transverse (or multiple) directions of the composite, for example, strands present in two or more directions.

The lack of adhesive or thermal bonding allows the formation of a lofty composite cleaning sheet with fibers extending on one or both sides of the protrusion containing backing elements or strands and preferably covering both faces of the backing elements or strands to provide a lofty composite cleaning sheet.

In one embodiment, the protrusion containing backing element can be longitudinally or transversely, or otherwise extending, discrete or loosely connected linear or nonlinear strand elements having protrusion elements on at least one face. Longitudinally extended discrete strands could then be fed into the hydraulic entanglement process. With at least this embodiment, it is possible to form an elasticated cleaning sheet composite by use of elastic woven or nonwoven webs. The entangled composite could then stretch between the strands due to an attached elastic web. If the strands are connected, but stretchable due to a loose connection, or if the strands are stretchable due to being nonlinear, elasticity could also be created. Some other types of backing elements, such as nettings, are stretchable or extensible in one or more directions, also permitting the creation of an elastic cleaning sheet laminate. Elasticity can also be created in a composite containing an extensible backing element and also having an extensible nonelastic web or nonwoven incorporated into the composite. Elasticity can also be created by elastic strands on a web or the like having elasticity extending at an angle to the direction of extensibility of the backing elements and any attached nonwoven created on the elastic composite. Elasticity can also be created by using elastic strand elements embedded within an extensible nonwoven.

Individual discrete protrusion containing strands could be formed from a conventional protrusion containing film by longitudinal slitting, fibrillation or other separation processes. Preferred are films having a molecularly oriented backing in the longitudinal direction of the film to assist in the splitting or slitting of the film. The film could be split for example by water jets, rotating blades, lasers, etc.

A first method of forming a protrusion containing netting useful in the invention is disclosed in U.S. Pat. No. 4,001,366 which describes forming hooks by extruding a backing and rib structures having the basic shape of the hook (similar to the methods described in U.S. Pat. Nos. 4,894,060 and 4,056,593). A reticulated web or mesh structure is formed by intermittently slitting (skip slitting) the extruded ribs and bases and then pulling to expand the skip slit structure into a mesh or netting. The slit ribs form the hook elements.

U.S. Ser. No. 10/376,979 (3M Case No. 58313US002) the substance of which is incorporated by reference in its entirety, discloses another method of making polymer hook containing netting by a novel adaptation of a known method of making hook fasteners as described, for example, in U.S. Pat. Nos. 3,266,113; 3,557,413; 4,001,366; 4,056,593; 4,189,809 and 4,894,060 or alternatively 6,209,177. This profiled extrusion method generally includes extruding a thermoplastic resin through a die plate, which die plate is shaped to form at least a base film layer and at least a first set of spaced ridges or ribs projecting above a first surface of the base layer. The spaced ridges or ribs formed by the die are used to form the first set of strands of a reticulated mesh or netting. The second set of transverse strands are formed by transversely cutting the base layer at spaced locations along a length, at a transverse angle to the ridges or ribs, to form discrete cut portions. Subsequently longitudinal stretching of the ridges (in the direction of the ridges or the machine direction) separates these cut portions of the backing, which cut portions then form the second set of spaced apart strands of the reticulated mesh or netting. The discrete protrusions are formed by providing at least a set of ribs or ridges having the basic profile of a protrusion and slitting these ribs in the transverse direction and orienting the ribs transverse to the cut direction. These protrusion containing ribs or ridges could be some or all of the first set of ribs or ridges or could be a second set of ribs or ridges on the second face of the base layer.

The above film extrusion process creates protrusion containing strands where the protrusions are created by cutting the ribs or ridges and generally stretching the backing or base layer. The basic protrusion cross-section is formed on the ribs by the profiled film extrusion die. The die simultaneously extrudes the film backing and the rib structures. The individual protrusions are then preferably formed from the ribs by cutting the protrusion shaped ribs transversely, followed by stretching the extruded film at least in the longitudinal direction of the cut protrusion shaped ribs. An uncut portion of the backing or the uncut ribs on the backing elongates and as such get thinner or smaller. However, the cut backing and/or the rib sections, between the cut lines remain substantially unchanged. This causes the individual cut sections of the ribs to separate each from the other in the direction of elongation forming discrete protrusions. Alternatively, using this same type extrusion process, sections of the rib structures can be milled out to form discrete protrusions. With this profile extrusion process, the basic protrusion cross section or profile is only limited by the die shape.

These cut ribs can also form the individual protrusion by partial transverse cutting of the ribs, which partially cut portions preferably has the base shape of the desired protrusion elements as described above. All the ribs will have an uncut portion in a preselected plane. The uncut portions of the ribs will form strands, with discrete protrusions on them, when the film is stretched in the direction of the ribs. A second set of transverse strands can then be formed by transversely cutting through the base film layer at spaced locations along a length, at a transverse angle to the ribs, to form discrete cut portions. Subsequently longitudinal stretching of the ribs (in the direction of the ribs or the machine direction) separates these cut portions of the backing, which cut portions then form the second set of spaced apart strands of the reticulated mesh or netting. The uncut portions of the ribs elongate and form strands at an angle to the strands formed by the cut backing. The stretching also orients the uncut portion of the hook shaped ribs increasing their strength and flexibility.

Figure 1:
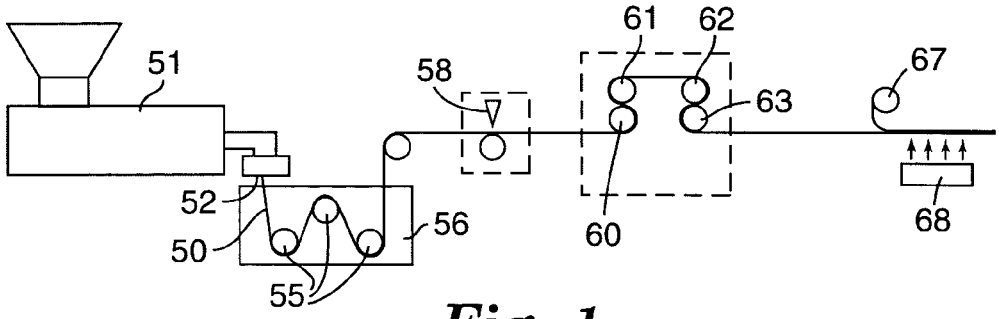
FIG. 1 schematically illustrates a method for making a protrusion containing netting such as shown in FIGS. 3 and 4 and cleaning sheet as shown in FIG. 5.
Figure 2:
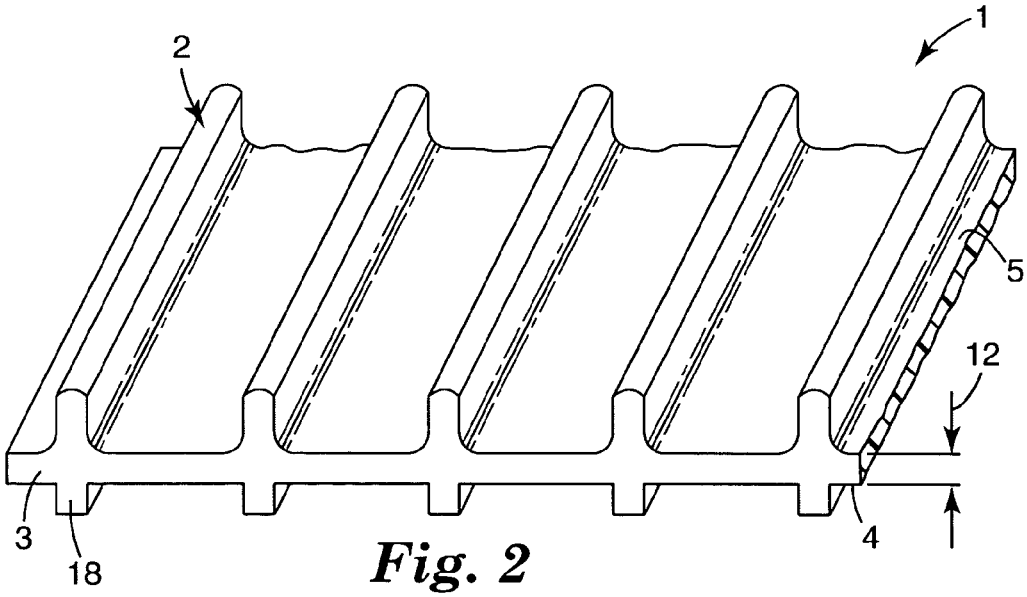
FIG. 2 is a perspective view of a precursor film used to make a protrusion containing netting of FIG. 3(*b*).
Figure 3A:
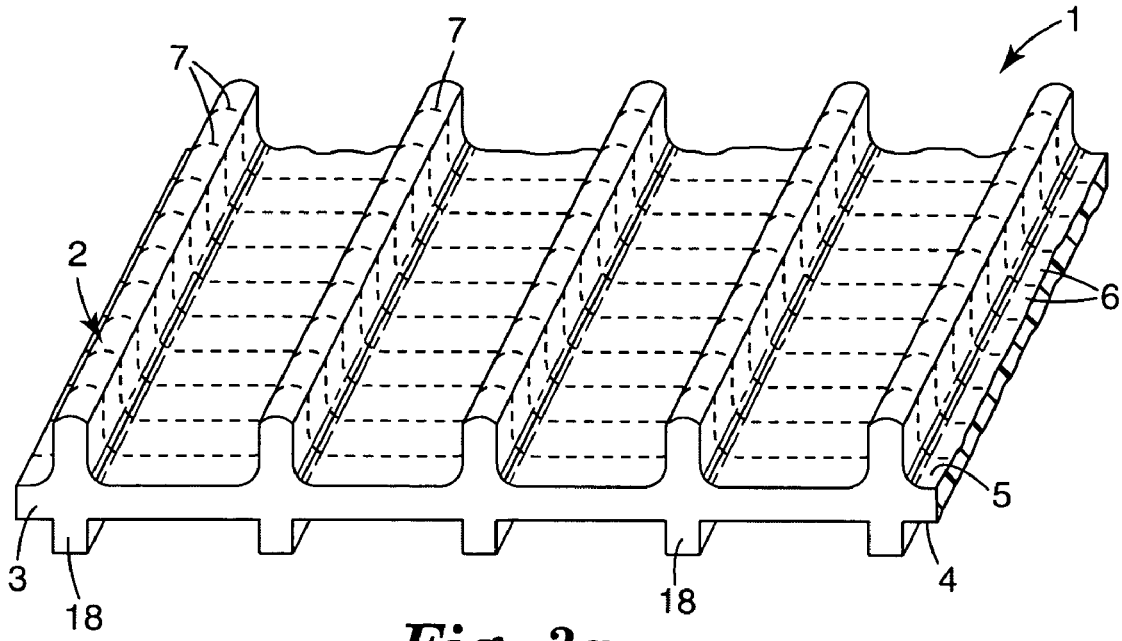
FIGS. 3(*a*) and (b) are perspective views of a (a) first embodiment cut precursor film for forming a protrusion containing netting in accordance with the present invention and (b) the cut precursor film formed into a netting.
Figure 3B:
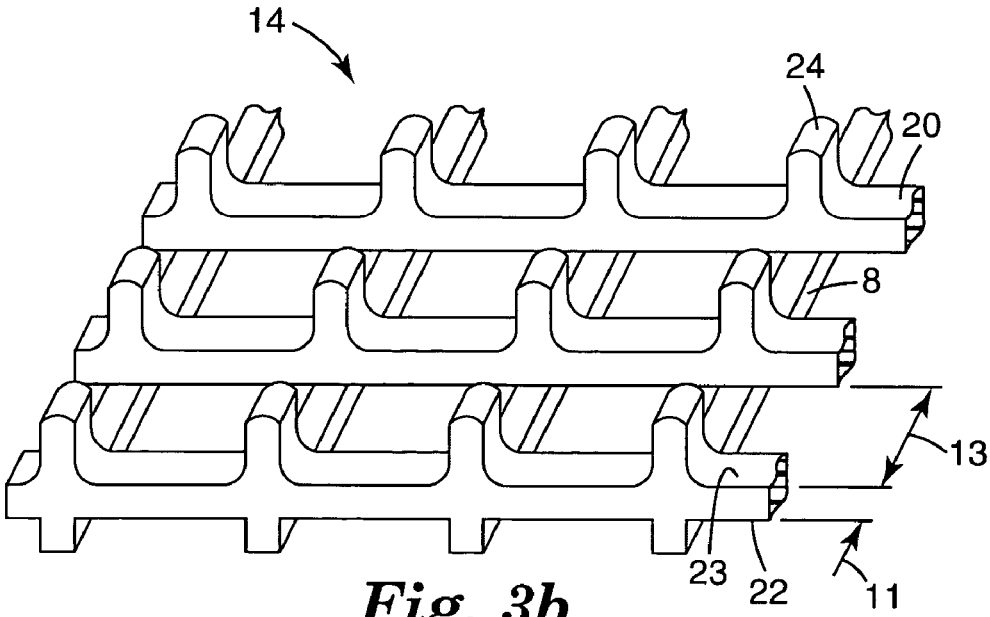
Figure 4A:
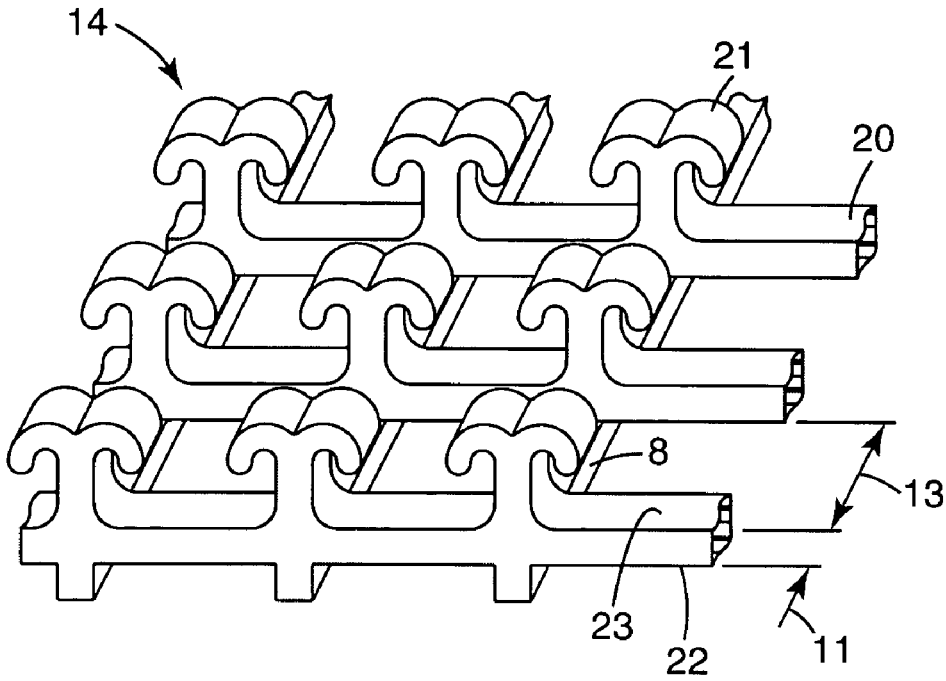
FIGS. 4(*a*)-4(*d*) are perspective views of various embodiments of a one sided protrusion type netting used in the present invention.
Figure 4B:
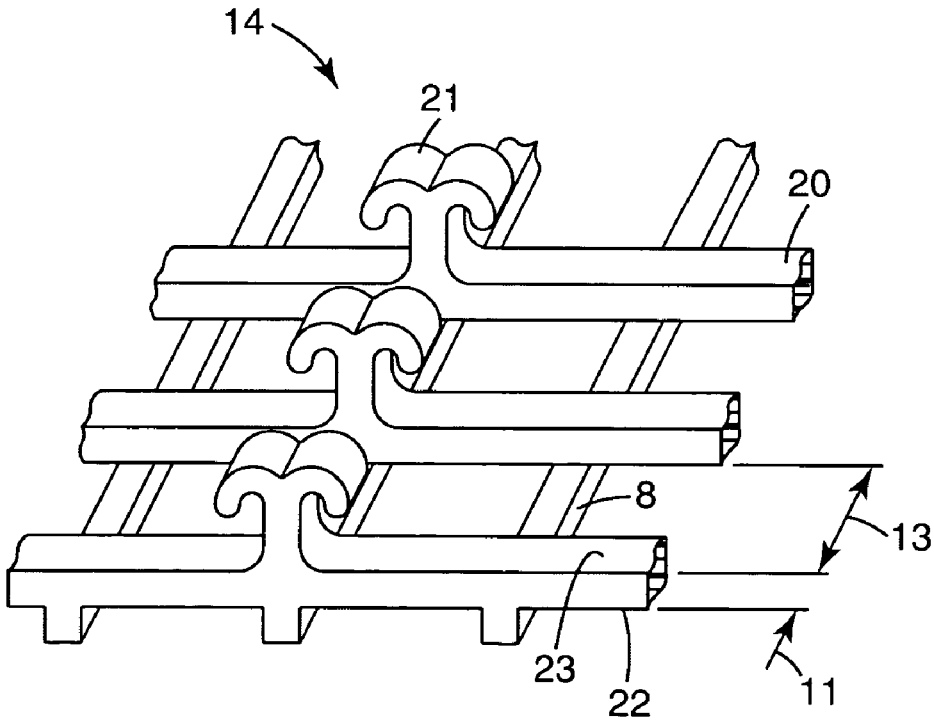
Figure 4C:
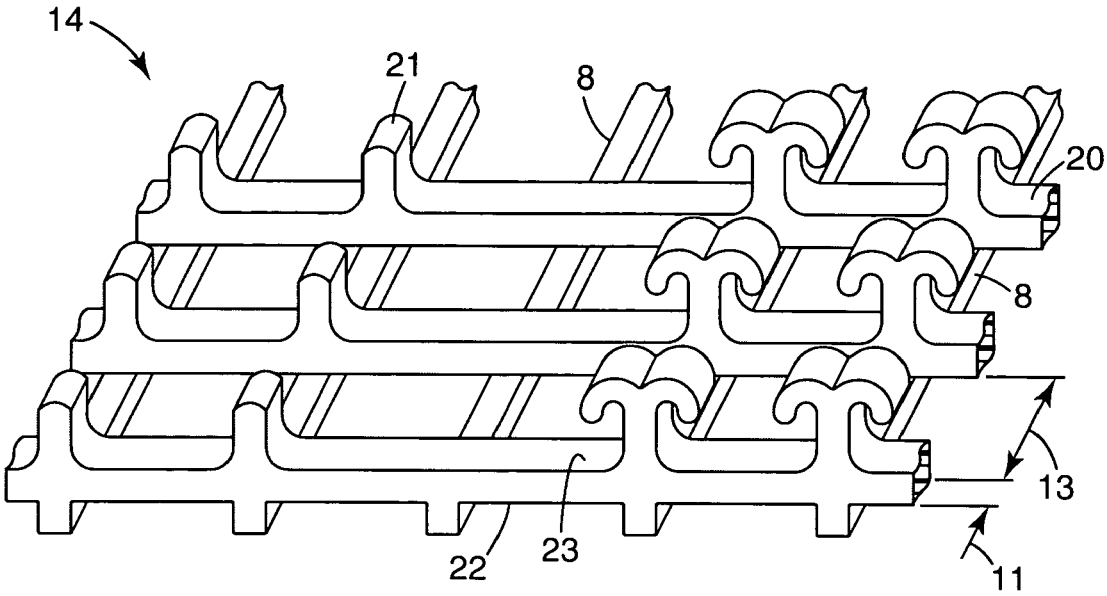
Figure 4D:
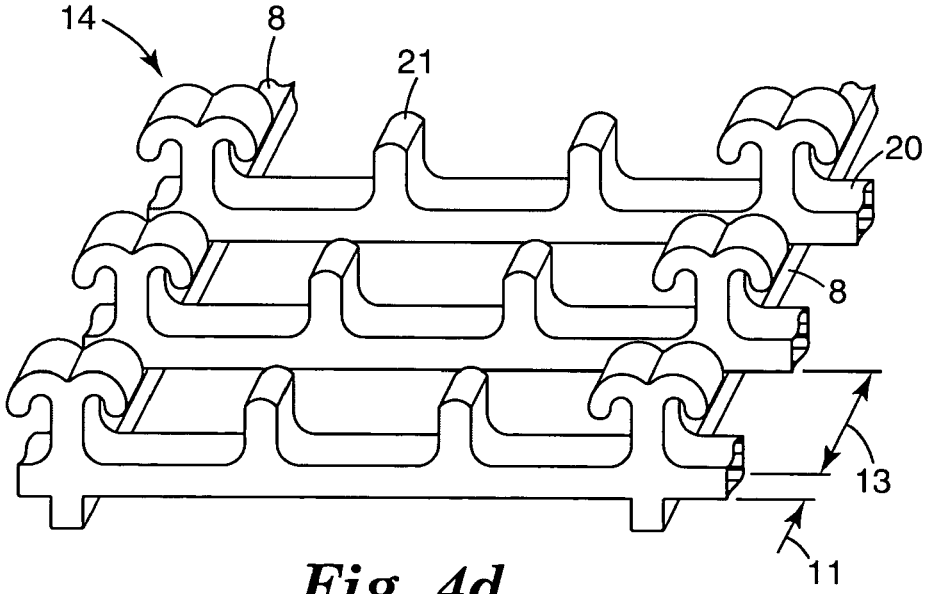

The above method for forming a reticulated mesh or netting, such as that of FIGS. 3(*a*)-3(*b*) and 4(*a*)-4(*d*), is schematically illustrated in FIG. 1. Generally, the method includes first extruding a strip 50, such as the strip 1, shown in FIG. 2, of thermoplastic resin from an extruder 51 through a die 52 having an opening cut, for example, by electron discharge machining, shaped to form the strip 50 with a base 3, and elongate spaced ribs 2 projecting from at least one surface 5 of the base layer 3 that have a predetermined cross sectional shape of the desired protrusion. As shown in FIGS. 2 and 3, the ribs 2 have a structure of a stem but could also have a hook type structure such as shown in FIGS. 4, 5 and 6. If desired, a second set of ridges or ribs 18 can be provided on the second surface 4 of the base layer 3 which second set of ribs or ridges can have any predetermined shape. The strip 50 is pulled around rollers 55 through a quench tank 56 filled with a cooling liquid (e.g., water), after which at least the base layer 3 is transversely slit or cut at spaced locations 7 along its lengths by a cutter 58 to form discrete portions 6 of the base layer 3. This would also require cutting of any ribs present on at least one face of the base layer. The distance between the cut lines 7 corresponds to about the desired width 11 of the strand portions 20 to be formed, as is shown in FIG. 3(*b*) and FIGS. 4(*a*)-(*d*). The cuts 7 can be at any desired angle, generally from 90° to 30° from the lengthwise extension of the ribs 2 and/or 18. Optionally, the strip can be stretched prior to cutting to provide further molecular orientation to the polymers forming the base layer 3 or ribs 2 and/or 18 and reducing the size of the ridges or ribs 2 and/or 18 or base layer thickness 12 and also reducing the size of the strands 20 formed by slitting of the base layer 3. The cutter 58 can cut using any conventional means such as reciprocating or rotating blades, lasers, or water jets, however preferably it cuts using blades oriented at an angle of about 60 to 90 degrees with respect to lengthwise extension of the ribs 2.

After cutting of the base layer 3 and the ridges or ribs 2 and/or ribs 18, the strip 1 is stretched at a stretch ratio of at least 1.5, and preferably at a stretch ratio of at least about 3.0, preferably between a first pair of nip rollers 60 and 61 and a second pair of nip rollers 62 and 63 driven at different surface speeds. This forms the first set of oriented strands 8 from ribs 18 as shown in FIG. 3(*b*). Optionally, the strip 1 can also be transversely stretched to provide orientation to the strands 20 in their lengthwise extension. This basic method of extrusion, cutting (of at least the base layer) and stretching would generally apply to all embodiments of the invention. Roller 61 is preferably heated to heat the base 3 prior to stretching, and the roller 62 is preferably chilled to stabilize the stretched base 3. Stretching causes spaces 13 between the cut portions 6 of the base layer 3, which cut portions of the base layer then become the second set of strands 20 for the completed netting 14. The fibrous web or webs are then fed, for example, from a roll 67, into the entanglement station 68 which embeds the netting within a fibrous web. A fibrous web could be applied to one or preferably both faces of the netting.

Referring to FIGS. 3(*b*) and 4(*a*), exemplary polymeric nettings which can be produced with a variation in the ribs forming stem-like protrusions 24 or hook shaped protrusions 21 generally designated by the reference numeral 14 is shown. The netting comprises strands 20 having generally parallel upper and lower major surfaces 23 and 22, and a multiplicity of spaced protrusions 24 or 21 projecting from at least the upper surface 23 of the strand 20. The strand 20 can have planar surfaces or other surface features as could be desired for modifying properties such as flexibility. The strands 20 are separated from each other by cuts and elongation of ribs 18 into strands 8. In FIG. 4(*a*), the protrusions are in the shape of hook elements. FIG. 4(*b*) is a variation of the FIG. 4(*a*) embodiment where the hook elements are more widely spaced and are not directly adjacent each strand member 8. The hook elements could also be created offset from strand members 8 and located between strands 8, as shown in FIG. 4(*d*), on strands 20. FIG. 4(*c*) is a further variation like FIG. 4(*b*). The absence of hook elements in certain areas of a netting or mesh as shown in FIGS. 4(*b*) and 4(*c*) would provide areas without hooks for example to provide an area without protrusions for bonding to a further substrate, such as by thermal bonding or adhesives. The FIG. 4(*d*) embodiment could be used to form a cleaning sheet with discrete hook strands extending only in the transverse direction. The fibrous composite could be formed using the FIG. 4(*d*) material with the strands 8 stabilizing the strands 20 in the transverse direction while it is joined to the fibrous webs. The portions containing the strands 8 could then be trimmed away leaving only the strands 20 in the final cleaning sheet composite. This would be useful in certain applications where tensile strength is needed in only one direction.

FIG. 5 shows the final cleaning sheet composite where a netting, such as shown in FIG. 4(*a*), is embedded within nonwoven webs placed on both faces of the netting. The netting and nonwoven layers are not additionally bonded together by thermal bonding or adhesives.

An extruded netting is schematically shown, within a cleaning sheet composite, in FIG. 6. In FIG. 6, the hook shaped ribs on one face are partially transversely slit at spaced locations along their lengths. The base layer on the second face is fully cut as per, e.g., the FIGS. 4 and 5 embodiments. When the partially cut hook shaped ribs are longitudinally elongated or stretched, as per the FIGS. 4 and 5 embodiments, they form hook elements 72 and oriented strands 78 (from the uncut portion of the ribs).

Cleaning sheets, such as shown in FIGS. 5 and 6, are highly breathable and dimensionally stable, in at least the direction of strands 8, 20, 70 or 78. Dimensional stability means that the cleaning sheet will have essentially the same dimensions when untensioned and when placed under moderate tension in the direction of linearly extending strands (e.g., 8, 20, 70 and 78). Further, these cleaning sheets would also be dimensionally stable in more than one direction if there are intersecting linear strands at angles to each other. However, with intersecting linear strands, when stretched in a direction at an angle to both sets of linear strands, the netting and as such the composite will stretch, and in some cases will tend to elastically recover to its dimensionally stable form. The linear strands in both directions can be oriented to increase their mechanical strength and reduce their basis weight while increasing their flexibility and dimensional stability.

The protrusions extend outward from the cleaning sheets to enhance the pick-up of particulate materials, especially animal hair or human hair, from surfaces, especially soft surfaces such as carpeting, upholstery, and the like. In a preferred embodiment, the protrusions are chosen such that they do not snag or get caught by the fibers of the surface. Generally, the protrusions are from 0.10 to 6 mm, preferably 0.25 to 4 mm.

The protrusions can be of a variety of shapes including, but not limited to, hooks, slanted fibers, bristles, and the like. The plurality of protrusions affixed to the substrate can be all of a uniform shape or can be a combination of different shapes. Preferably in some embodiments at least some of the protrusions are hook-shaped protrusions. Preferred hook-shaped protrusions include a variety of types, including, for example, "J-type" hooks, "Prong-type" hooks, "Mushroom-type" hooks, "Banana-type" hooks, "Y-type" hooks, "Multi-tipped" hooks and the like.

The protrusions and strands incorporated into the present invention cleaning sheets can be made of a variety of materials, for example, polymeric resins, and the like, preferably thermoplastic resins. The thermoplastic resins preferably comprise a thermoplastic polymer and could further comprise tackifying resins, plasticizers, and other optional ingredients such as diluents, stabilizers, antioxidants, colorants, and fillers.

The preferred materials from which to form protrusions of the present cleaning sheets are thermoplastic resins. The thermoplastic resins herein will typically have a softening temperature of from about 45° C. to about 260° C., more preferably from about 80° C. to about 200° C., and even more preferably from about 90° C. to about 180° C. "Softening temperature" of a thermoplastic resin can be measured according to a standard method, ASTM D1525. Preferred thermoplastic resins comprise thermoplastic polymers such as styrene copolymer blends, wherein the copolymer is selected from the group consisting of butadiene, acrylonitrile, divinylbenzene, maleic anhydride; block copolymers containing polystyrene endblocks and polyisoprene, polybutadiene, and/or polyethylene-butylene midblocks; polyolefins such as polyethylene, polypropylene, and polyethylene propylene; ethylene-vinylacetate copolymers; acrylonitrile-butadiene copolymers; polyesters such as polyethylene terphthalate; polyamides such as Nylon 6 and Nylon 11; polyvinyl chloride; polyvinylidene chloride; polyurethane; and mixtures thereof.

Thermoplastic resins particularly preferred herein for forming protrusions of the present cleaning sheets include polyethylene (which can be low density, high density and/or cross linked), polypropylene, blends and copolymers thereof.

Preferred polymeric materials from which a netting can be made include thermoplastic resins comprising polyolefins, e.g. polypropylene and polyethylene, polyvinyl chloride, polystyrene, nylons, polyester such as polyethylene terephthalate and the like and copolymers and blends thereof. Preferably the resin is a polypropylene, polyethylene, polypropylene-polyethylene copolymer or blends thereof.

The preferred protrusions of the present cleaning sheets are formed of a material having a Young's modulus of from about 75 to about 1500 kN/m$^2$ ($\times 10^{-4}$), preferably from about 100 to about 1000 kN/m$^2$ ($\times 10^{-4}$), and more preferably from about 200 to about 500 kN/m$^2$ ($\times 10^{4}$). Young's modulus can be measured using a standard method known as ASTM D797.

In general, the strands will be embedded within the fibrous substrate such that the strands and the protrusions are present from about 5% to about 80%, preferably from about 10% to about 70%, and more preferably from about 15% to about 60% of the surface area within the fibrous substrate. The protrusions can extend from only one outer surface of the substrate of the cleaning sheet but the protrusions can also be extend from both outer surfaces.

The protrusions can be positioned such that the distance between two consecutive protrusions will be at least 0.15 mm, or from about 0.2 to about 10 mm, preferably from about 0.2 to about 5 mm, preferably from about 0.3 to about 5 mm, more preferably from about 0.6 to about 3 mm, even more preferably from about 0.8 to about 3 mm, and most preferably from about 0.9 to about 2 mm. The number of protrusions per square centimeter will typically be from about 1 to about 1000, preferably from about 10 to about 100, and more preferably from about 20 to about 50.

The present cleaning sheets comprise a plurality of protrusions, which can all be of the same shape or can be a combination of protrusions having two or more different shapes. It is also possible to have a plurality of protrusions which are all facing towards the same direction or which are pointing towards different directions. The shapes and resiliency of the protrusions are preferably selected based on the surface desired to be cleaned, especially soft surfaces such as carpet, upholstery, and the like, in order provide the best combination or debris removal and easy movement of the cleaning sheet across the surface. For example, the shape and resiliency of the protrusions can also be selected based on the type of carpet or upholstery being cleaned with more aggressive hooks (e.g. less elasticity and/or more curl in the engagement end of the hook) used on plush carpet, while less aggressive hooks (e.g. more elasticity and/or less curl in the engagement end of the hook) are preferred for loop-type carpet, such as berber carpet. Typically, the thinner the protrusions and the greater the distance between individual protrusions, the less aggressive the resulting cleaning sheet will be.

The protrusions of the present cleaning sheets are capable of dislodging debris from the surface to be cleaned so that the fibrous substrate can capture the debris within the cleaning sheet. Since the debris is retained within the fibrous cleaning sheet, once the user is finished cleaning the surface, the user can simply dispose of the cleaning sheet, along with the debris retained by the cleaning sheet.

The protrusions of the present cleaning sheets can be distributed in a random or non-random pattern on the substrates of the present cleaning sheet. The protrusions can be arranged in one or more discrete zones with respect to the substrate of the cleaning sheet, wherein each zone comprises a plurality of protrusions.

Figure 8:
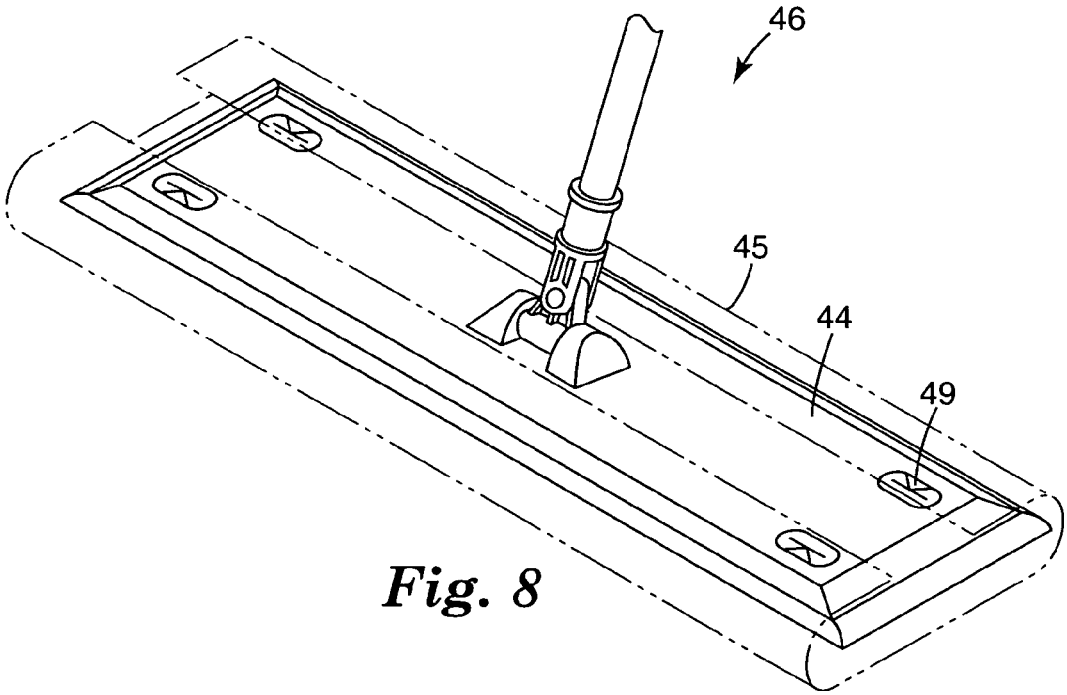
FIG. 8 is a perspective view of a cleaning mop using a disposable cleaning sheet of the invention.

In a preferred embodiment, the protrusions are arranged in a zone on the substrate of the cleaning sheet, such that when the cleaning sheet is attached to a mop head of a cleaning implement 46, the protrusions are aligned with the bottom surface (and/or sides) of the mop head 44 so as to be contacted with the surface to be cleaned, as shown in FIG. 8. The areas of the substrate of the cleaning sheet 45 adjacent to the centered zone comprising a plurality of protrusions, are free of protrusions and can be used to attach the cleaning sheet to the mop head of the cleaning implement at attachment point 49. In another embodiment, when a cleaning sheet of the present invention is attached to a mop head 44 of a cleaning implement 46, a plurality of protrusions could be affixed to the substrate in a zone along the leading and/or trailing edge of the mop head, or around the vertical edges of the mop head.

In yet another embodiment, a cleaning sheet can comprise any of the previously described protrusions, combination of protrusions, rows of protrusions and/or zoned application of protrusions, on both sides of the sheet. This embodiment offers the advantage of doubling the usage of a single sheet. A user can simply attach the sheet to a cleaning implement as later described and use it to clean a surface. When the sheet appears "saturated" with hair or particles, the user can simply remove the sheet from the implement, and re-attach or otherwise use the sheet such that the still clean side of the sheet can now be used to clean the surface.

The present disposable cleaning sheets can optionally, but preferably, further comprise an additive material. The additive material can be affixed to the substrate of the present cleaning sheets in order to enhance the ability of the present cleaning sheets to better retain debris, especially small particulate matter, that has been removed from a surface being cleaned.

A number of additive materials can be suitable for incorporation into the cleaning sheets of the present invention. Preferred additives of the present invention that are particularly useful with the present cleaning sheets are polymeric additives, especially those with specific adhesive characteristics such as specific Tack Values, Adhesive Work Values, Cohesion/Adhesion Ratios, and/or Stringiness Values. The additive material is selected in order to improve the pick-up of fine particulate matter such as dust, lint, and hair, and especially larger particulate matter typically found on household floors and surfaces such as crumbs, dirt, sand, hair, crushed food, grass clippings and mulch. In addition, the type and amount of the additive material is carefully selected in order to improve particulate pick-up of the cleaning sheet, while maintaining the ability of the cleaning sheet to easily glide across the surface being cleaned. If the cleaning sheet is too tacky as a result of the additives incorporated therein, the cleaning sheet will not easily glide across the surface.

Preferred polymeric additives include, but are not limited to, those selected from the group consisting of pressure sensitive adhesives, tacky polymers, and mixtures thereof.

The additive material can be affixed to the substrate itself, or can be affixed to the protrusions herein. The additive material can be applied uniformly to the substrate and/or protrusions, or can be applied in "zones". When applying the additive material in zones, the additive material can be applied in a random or non-random pattern, such as a checkerboard pattern. In one embodiment, the additive material is distributed evenly across a wide central portion of the substrate.

Other suitable additive materials include wax, oil, powder, and mixtures thereof. Preferred wax is paraffin wax and preferred oil is mineral oil. Suitable powders for use herein include, but are not limited to, those selected from the group consisting of talc, starch, magnesium carbonate, and mixtures thereof.

Typically, the additive materials, such as polymeric additives, are impregnated onto the present cleaning sheets at a level of polymeric additive of no greater than about 10.0 g/m$^2$, preferably no greater than about 6.0 g/m$^2$, more preferably no greater than about 4.0 g/m$^2$, and still more preferably no greater than about 2.0 g/m$^2$. Also, the additive materials, such as polymeric additives, are typically impregnated onto the present cleaning sheets at a level of polymeric additive of at least about 0.1 g/m$^2$, preferably at least about 0.2 g/m$^2$, more preferably at least about 0.4 g/m$^2$, and still more preferably at least about 0.6 g/m$^2$. The polymeric additive can be applied directly to the substrate by any conventional means such as spraying, slot coating, printing, or kiss coating.

The disposable cleaning sheets of the present invention can be attached to a mop head of a cleaning implement as shown in FIG. 8. The cleaning implement can then be used to move the disposable cleaning sheet across the surface being cleaned, e.g. carpet. After the surface has been cleaned, the disposable cleaning sheet can be removed from the mop head of the cleaning implement and discarded.

A cleaning sheet could be used as a simple sheet or could be attached to a hand of a user, for example, by elastic bands. The sheet could also have attachment means such as for example, an adhesive or hook and loop fastener for connecting one end to the other. In this embodiment, the ends of the sheet can be wrapped around the hand and secured to one another to form a snug fit.

Figure 7:
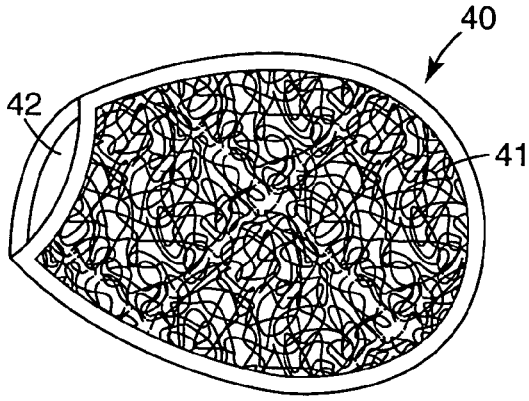
FIG. 7 is a top view of a mitt including a cleaning sheet of the invention.

The sheets could also be used to form a disposable mitt 40 as shown in FIG. 7 comprising at least a layer of substrate 41 having protrusions.

The surface to be cleaned is preferably simply contacted by wiping the surface with the cleaning sheet with the cleaning sheet containing the debris disposed after use. Surfaces which can be cleaned with the cleaning sheets, include carpet, upholstery, and fabrics, which can be found in the household, automobiles, and the like. The cleaning sheet can also be incorporated as part of a brush for brushing the hair of cats and other pets.

EXAMPLE 1

A mesh hook netting was made using apparatus similar to that shown in FIG. 1. A polypropylene/polyethylene impact copolymer (SRC7-644, 1.5 MFI, Dow Chemical) was extruded with a 6.35 cm single screw extruder (24:1 L/D) using a barrel temperature profile of 175° C.-230° C.-230° C. and a die temperature of approximately 230° C. The extrudate was extruded vertically downward through a die having an opening cut by electron discharge machining to produce an extruded profiled web. The crossweb spacing of the upper ribs was 7.3 ribs per cm. After being shaped by the die, the extrudate was quenched in a water tank at a speed of 6.1 meter/min with the water being maintained at approximately 10° C. The web was then advanced through a cutting station where the upper ribs and the base layer (but not the lower ribs) were transversely cut at an angle of 23 degrees measured from the transverse direction of the web. The spacing of the cuts was 305 microns. After cutting the upper ribs and the base layer, the web was longitudinally stretched at a stretch ratio of approximately 3 to 1 between a first pair of nip rolls and a second pair of nip rolls to further separate the individual hook elements to approximately 8.5 hooks/cm to produce a hook mesh netting similar to that shown in FIG. 4*a*. The thickness of the base layer was 219 microns. The upper roll of the first pair of nip rolls was heated to 143° C. to soften the web prior to stretching. The second pair of nip rolls were cooled to approximately 10° C.

The tensile strength of the hook netting was measured by cutting a 1.3 cm wide sample in the longitudinal, downweb direction of the web. There were 11-12 strands in the test samples. The break tensile strength was measured using an INSTRON tensile tester. 5 replicates were run and averaged together. The break tensile strength of the web was 4.91 kg/cm and 0.55 kg/strand.

The hook netting was then hydroentangled with two nonwoven webs by sandwiching the hook netting in between two 30 g/m$^2$ unbonded carded webs; each web consisting of 70% Wellman T310 1.5d polyester fibers, 25% Lyocell 1.5d rayon fibers and 5% Kosa T254 2d polyester bicomponent staple fibers. A conventional hydraulic entangling system consisting of 6 manifolds/jets (3 above and 3 below the web) was used. The basic operating procedure is described in, for example, U.S. Pat. No. 5,389,202, issued Feb. 14, 1995, to Everhart et al., the contents of which are incorporated herein by reference. Each manifold had an orifice diameter of 120 microns. Orifices were positioned in a single row at a spacing of about 16 orifices per linear centimeter of manifold. Manifold water pressure was successively ramped up to 127 kg/cm$^2$ which generated high energy fine columnar jets. The hydraulic entangling surface was a single layer 100 stainless steel twill wire backing manufactured by Albany International, Portland, Term. The netting and two carded webs were passed under the manifolds at a line speed of about 10 meters per minute where they were washed and consolidated by the pressurized jets of water. The resulting composite web was dried utilizing a conventional laboratory handsheet dryer. The composite web had a cloth-like feel and appearance, and was very flexible and conformable. A small piece of the composite web was used to lightly scrub a soiled carpet. The web was very efficient in removing hair from the carpet.

We claim:

1. A cleaning sheet comprising a composite of a protrusion containing backing element embedded within a fibrous substrate, the composite having a first face and a second face and the protrusion containing backing element having a first face and a second face with protrusions extending from at least one face of the backing element such that these protrusion extend out so as to form at least in part a first face of the composite, wherein the protrusion containing backing element is embedded within the fibrous substrate such that individual fibers forming the fibrous substrate are present on both faces of the backing element so that the individual fibers forming the fibrous substrate form at least in part the first and second face of the composite, the protrusion containing backing element is formed of substantially continuous first and second sets of intersecting strand elements extending in at least two directions where at least one set of strand elements have integral extrusion formed protrusions extending from at least one face of the strands, the two sets of strands being separated from one another and where individual fibers forming the fibrous substrate are located between the strands.

2. The cleaning sheet of claim 1 wherein the protrusion containing backing element comprises discrete protrusion containing strands.

3. The cleaning sheet of claim 1 wherein the strand elements extend linearly in at least the at least one direction.

4. The cleaning sheet of claim 1 wherein the strands are mutually parallel and extend in the longitudinal direction of the composite.

5. The cleaning sheet of claim 1 wherein the fibrous substrate is a nonwoven fibrous substrate.

6. The cleaning sheet of claim 5 wherein the nonwoven fibrous substrate has a basis weight of from 10 to 500 g/m$^2$.

7. The cleaning sheet of claim 5 wherein the nonwoven fibrous substrate is substantially unbonded by secondary bonding means.

8. The cleaning sheet of claim 5 wherein the nonwoven fibrous substrate is an unbonded carded nonwoven substrate.

9. The cleaning sheet of claim 5 wherein the composite is an elastic composite.

10. The cleaning sheet of claim 1 wherein the composite protrusions are 0.10 to 6 mm.

11. The cleaning sheet of claim 1 wherein the protrusions are formed of a thermoplastic polymer.

12. The cleaning sheet of claim 11 wherein the protrusions are formed of polyolefin, polystryrenes, polyesters or polyurethanes, polyvinyl chloride and/or mixtures thereof.

13. The cleaning sheet of claim 12 wherein the thermoplastic polymer further comprises a tackifying resin, a plasticizer, a diluent, a stabilizer, an antioxidant, a colorant or a filler or combinations thereof.

14. The cleaning sheet of claim 5 wherein the second set of strands extends in a direction transverse to the first set of strands and the two sets of strands are joined at their crossover points.

15. The cleaning sheet of claim 14 wherein said second set of strands are mutually parallel and have a first face and a second face and two substantially parallel side faces and are substantially coextensive.

16. The cleaning sheet of claim 14 wherein said second set of strands second faces are attached to said first set of oriented strands at their crossover points.

17. The cleaning sheet of claim 14 wherein said first set of oriented strands occupy a first planar cross-sectional area in the thickness direction of the netting and said second set of oriented strands occupy a second planar cross-sectional area in the thickness direction of the netting.

18. The cleaning sheet of claim 17 wherein said first and second planar cross-sectional areas are substantially mutually exclusive and abutting.

19. The cleaning sheet of claim 14 wherein said second set of strands have a substantially rectilinear cross-section.

20. The cleaning sheet of claim 14 wherein said second set of strands are linear.

21. The cleaning sheet of claim 19 wherein adjacent strands of said second set of strands have a substantially identical cross-sectional shape in said first direction.

22. The cleaning sheet of claim 14 wherein said second set of strands have surface structures on said first faces of the strands.

23. The cleaning sheet of claim 22 wherein said surface structures are stems extending upward.

24. The cleaning sheet of claim 23 wherein said stem structures have protrusions projecting in at least one direction.

25. The cleaning sheet of claim 24 wherein said protrusions extend in the direction of the second set of strands.

26. The cleaning sheet of claim 24 wherein said protrusions extend in two or more directions and form a mushroom.

27. The cleaning sheet of claim 14 wherein said first set of strands have surface structures on said second face of said strands.

28. The cleaning sheet of claim 27 wherein said surface structures are stems extending upward.

29. The cleaning sheet of claim 28 wherein said stem structures have protrusions projecting in at least one direction.

30. The cleaning sheet of claim 29 wherein said protrusions extend in a direction perpendicular to said first direction.

31. The cleaning sheet of claim 14 wherein said first and second set of strands are integrally formed.

32. The cleaning sheet of claim 31 wherein the thermoplastic polymer further comprises a tackifying resin, a plasticizer, a diluent, a stabilizer, an antioxidant, a colorant or a filler or combinations thereof.

33. The cleaning sheet of claim 1 wherein there is an additional functional foraminous layer entangled with the fibrous substrate.

34. The cleaning sheet of claim 1 wherein the nonwoven is formed of natural fibers.

35. The cleaning sheet of claim 1 wherein the nonwoven is formed of synthetic fibers.

36. The cleaning sheet of claim 1 wherein the protrusions are present from about 5 to 80 percent of the surface area of the fibrous substrate.

37. The cleaning sheet of claim 36 wherein the protrusions are present from about 15 to 60 percent of the surface area of the fibrous substrate.

38. The cleaning sheet of claim 1 wherein the number of protrusions is from 1 to 1,000 per square centimeter.

39. The cleaning sheet of claim 38 wherein the number of protrusions is from 20 to 50 per square centimeter.

40. The cleaning sheet of claim 38 wherein the fibrous substrate is coated or impregnated with an additive.

* * * * *

UNITED STATES PATENT AND TRADEMARK OFFICE

CERTIFICATE OF CORRECTION

PATENT NO. : 7,462,385 B2
APPLICATION NO. : 10/686123
DATED : December 9, 2008
INVENTOR(S) : Jayshree Seth It is certified that error appears in the above-identified patent and that said Letters Patent is hereby corrected as shown below:

Column 4
Line 45, delete "4,612,226.," and insert -- 4,612,226, -- in place thereof.

Column 9
Lines 41-42, delete "terphthalate;" and insert -- terephthalate; -- in place thereof.
Line 61, delete "($x10^4$)." and insert -- ($x10^{-4}$). -- in place thereof.

Column 12
Line 37, delete "175° C.-230° C.-230° C." and insert -- 175° C.-230° C. -- in place thereof.

Column 13
Line 19, delete "Term." and insert -- Tenn. -- in place thereof.

Column 14
Line 8, Claim 12, delete "polystryrenes," and insert -- polystyrenes, -- in place thereof.

Signed and Sealed this

Third Day of November, 2009

David J. Kappos

David J. Kappos
*Director of the United States Patent and Trademark Office*